US007825873B2

(12) United States Patent
Fond et al.

(10) Patent No.: US 7,825,873 B2
(45) Date of Patent: Nov. 2, 2010

(54) BROADBAND ANTENNA

(75) Inventors: Emilie Fond, Grenoble (FR); Serge Perrot, Tullins (FR); Patrice Rigoland, Hamden, CT (US)

(73) Assignee: Radiall, Rosny Sous Bois (FR)

( * ) Notice: Subject to any disclaimer, the term of this patent is extended or adjusted under 35 U.S.C. 154(b) by 250 days.

(21) Appl. No.: 11/898,001

(22) Filed: Sep. 7, 2007

(65) Prior Publication Data

US 2008/0068281 A1 Mar. 20, 2008

(30) Foreign Application Priority Data

Sep. 20, 2006 (FR) ..... 06 53846

(51) Int. Cl.
*H01Q 1/36* (2006.01)

(52) U.S. Cl. ..... 343/895; 343/725

(58) Field of Classification Search ..... 343/700 MS, 343/725, 895, 833, 790, 791, 877, 846
See application file for complete search history.

(56) References Cited

U.S. PATENT DOCUMENTS 4,527,163 A 7/1985 Stanton
5,231,412 A * 7/1993 Eberhardt et al. ..... 343/790
5,835,065 A * 11/1998 Wallace et al. ..... 343/702
9,409,131 1/2002 Warnagiris
6,549,175 B1 * 4/2003 Cencich et al. ..... 343/830
6,864,853 B2 * 3/2005 Judd et al. ..... 343/844
RE40,129 E * 3/2008 Warnagiris ..... 343/895
2002/0113743 A1 8/2002 Judd et al.
2003/0038750 A1 * 2/2003 Chen ..... 343/700 MS
2006/0071873 A1 4/2006 Warnagiris

* cited by examiner

*Primary Examiner*—Michael C Wimer
*Assistant Examiner*—Kyana R Robinson
(74) *Attorney, Agent, or Firm*—Oliff & Berridge, PLC

(57) ABSTRACT

The present invention relates to an antenna comprising:

at least one central longitudinal radiating element; and at least one outer element comprising at least one rolled-up electrically-conductive sheet disposed around the central element, without electrical contact therebetween, the outer element presenting a height that is strictly decreasing, or alternatively that increases and decreases along the roll.

14 Claims, 1 Drawing Sheet

BROADBAND ANTENNA

The present invention relates to a broadband antenna that conserves its radiation pattern.

BACKGROUND

There are various topologies for antennas that are broadband in terms of voltage standing wave ratio (VSWR) and that can be used in various application fields (commercial, military, industrial, . . . ).

Thus, as examples, the topologies in the most widespread use are the following: antennas that are independent of frequency (spiral, log-periodic); and broadband dipoles (elliptical, volume, planar, . . . ). These topologies can be used in the context of making antennas that are directional or that are omnidirectional.

In another form, passband can be increased by means of an added matching network that can incorporate some number of discrete or pseudo-lumped components (capacitors, inductors, resistors, transformers, etc.).

One of the problems associated with using a matching network lies in the physical limitations that arise from making use of components. Thus, such solutions do not in any way make it possible to modify or shape the radiation characteristics of the individual radiating element. Furthermore, a matching network reduces the intrinsic power performance and efficiency of the radiating element. Nevertheless, in spite of certain radiation-shaping properties, the use of the above-mentioned broadband topologies does not make it possible to provide structures that are compatible with all applications.

Thus, with respect to form factor, such antennas need to present dimensions that are close to wave lengths. In addition, in order to obtain omnidirectional coverage, conventional form factors (wire antennas) cannot be satisfied, thereby making it more complicated to integrate beam-conserving antennas in applications of the portable or vehicle type.

With the arrival of new communications standards making use of time-division signals, such antennas also suffer from problems of dispersion relative to the position of the phase center, making it difficult if not impossible to implement such systems.

Nevertheless, several structures have been developed for the purpose of mitigating the above-mentioned problems.

U.S. Pat. No. 6,339,409 discloses an antenna formed by rolling up a single electrically-conductive sheet having the shape of a right-angled triangle.

US patent application No. 2006/0071873 describes an antenna as mentioned above connected to a ground-forming disk.

U.S. Pat. No. 4,527,163 describes a monostrip antenna having an outer element formed by a sheet cut out to present a Y-shape.

SUMMARY

The present invention seeks in particular to remedy the above-mentioned drawbacks associated with known antennas by means of a construction that is innovative.

The invention thus provides an antenna comprising:

at least one central longitudinal radiating element; and at least one outer element comprising at least one rolled-up electrically-conductive sheet disposed around the central element, without electrical contact therebetween, the outer element presenting a height that is strictly decreasing, or alternatively that increases and decreases, along the roll.

The antenna of the invention can be used on its own or as an antenna element in an array of antennas that are identical or different, and where appropriate either contacting or not contacting ground.

In an embodiment of the invention, the electrically-conductive sheet forming the outer element has a first side defining the maximum height of the outer element and a second side, in particular a side perpendicular to the first side, defining a base of the outer element.

By way of example, the conductive sheet may present the shape of a right-angled triangle, or it may have a third side interconnecting the first two sides and presenting a shape that decreases exponentially.

In a variant, the conductive sheet may have a third side interconnecting the first and second sides and formed by a succession of crenellations.

The minimum height of the outer element may be zero, or in a variant, it may be non-zero.

By way of example, the conductive sheet may have the shape of a right-angled triangle, which triangle may optionally be truncated at a vertex.

In an embodiment of the invention, the outer element comprises a rolled-up conductive sheet having the shape of an isosceles triangle, with the base of the triangle defining the maximum height of the outer element.

The outer element may be rolled in a spiral, in particular a variable-pitch spiral, specifically a logarithmic spiral.

The profile of the sheet constituting the outer element may be continuous, or it may be formed by a succession of plane portions.

The conductive sheet may be rolled up from one or the other of its ends, and from the inside towards the outside or from the outside towards the inside relative to the central radiating element.

The central radiating element may be of any type.

For example, the radiating element may be of the dipole type, in particular it may be a printed or a cylindrical dipole.

The outer element may be considered as an impedance transformer when it is arranged to operate without contacting ground and purely by electromagnetic coupling. The antenna is then said to have a "continuous profile".

In another embodiment of the invention, the outer element is arranged to operate while in contact with ground and can be considered as being an extension of that ground. The antenna is then said to have a "matching sleeve".

The radiating element may be a monopole, a dipole, a helix, an ellipse, or a combination of these elements.

The radiating element may be a printed or cylindrical dipole, for example.

All of the elements of the antenna may be made of conducive materials or may comprise printed circuit cards.

The central radiating element and the outer element may be surrounded by a dielectric material, in particular by being embedded at least in part in the dielectric material. In a variant, it is possible to use a dielectric material in sheet form that is rolled around the central radiating element and the outer element.

Whether or not the outer element is associated with ground, and depending on the periodicity of the outer element, the antenna of the invention may be ultra-broadband or of the multi-band type.

The broad bandwidth and the high efficiency of the antenna of the invention enables it to operate at high power.

The invention also enables the antenna to be miniaturized, using dimensions that are of the order of one-tenth of the wavelength.

The antenna of the invention can thus be used in all types of application, in particular in appliances that are portable or vehicle-mounted.

The invention can be used in particular for mobile applications, in particular in the field of portable appliances or vehicles, or in a variant it can be used in infrastructure, for example in the field of base stations.

The invention also makes it possible to obtain a radiation pattern that can be selected to be directional, sector-shaped (antenna in an array), or omnidirectional.

The invention enables the following advantages to be achieved in particular:

- a substantially constant radiation pattern to be obtained in dipole mode, whether directional or otherwise, over its operating band;
- high efficiency because of the topology of the antenna;
- conserving its broadband characteristic in a wide variety of integration environments, in particular in environments that make use of a ground plane; and
- compactness, given its broadband characteristic.

BRIEF DESCRIPTION OF THE DRAWING

The invention can be better understood on reading the following detailed description of non-limiting embodiments of the invention and on examining the accompanying drawing, in which.

MORE DETAILED DESCRIPTION

Figure 1:
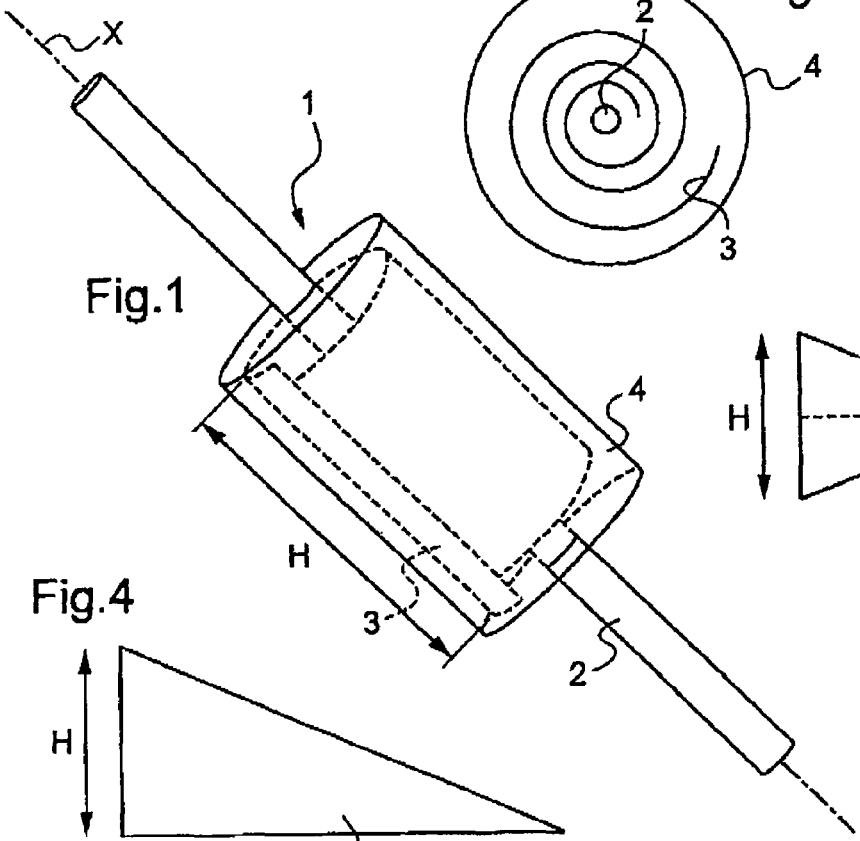
FIG. 1 is a diagrammatic fragmentary view of an antenna with a dipole radiating element and in accordance with the invention.

FIG. 1 shows a so-called "continuous profile" antenna 1 comprising a central radiating element 2 of the dipole type having a longitudinal axis X, and an outer element 3 drawn in dashed lines and that can be said to be partially parasitic, surrounding the radiating element 2.

The antenna 1 shown has a dielectric material 4 in which the radiating element 2 and the outer element 3 are embedded, at least in part.

In a variant, the radiating element 2 and the outer element 3 may be separated by air.

The radiating element 2 may be of any type, for example a printed or cylindrical dipole, and it is may be in the form of a rod.

The outer element 3 can be considered as being an adaptive load, and it is not connected to any ground.

Figure 3:
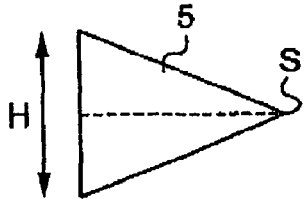
FIG. 3 is a diagrammatic and fragmentary view showing the conductive sheet used for forming the outer element of the FIG. 1 antenna.

In the example shown, the outer element 3 is formed by a rolled-up electrically conductive sheet 5 that has the shape of an isosceles triangle, as shown in FIG. 3. In a variant, the shape of the triangle may be arbitrary.

Figure 2:
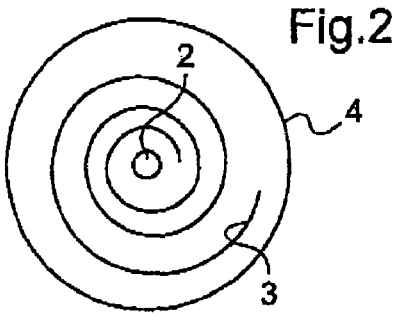
FIG. 2 is a diagrammatic plan view of the FIG. 1 antenna.

The sheet 5 may be rolled in a spiral, for example a variable-pitch spiral, as can be seen in FIG. 2.

The maximum height H of the outer element 3 measured along the axis X corresponds to the length H of the base of the isosceles triangle of the sheet 5.

In the example described, the outer element 3 presents a minimum height along the roll axis that is zero, corresponding to the vertex H of the isosceles triangle opposite from its base.

The antenna 1 may be of the type presenting an ultra-broad band.

The outer element 3 may present other shapes.

Figure 4:
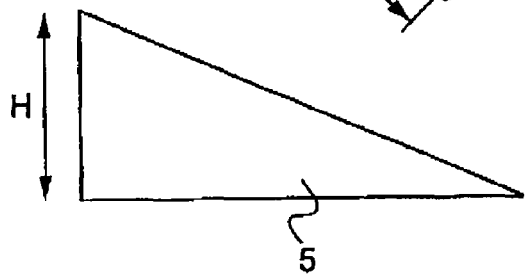
FIGS. 4 to 7 are diagrammatic and fragmentary views showing other examples of sheets that can be used to form the outer element of the antenna of the invention.
Figure 5:
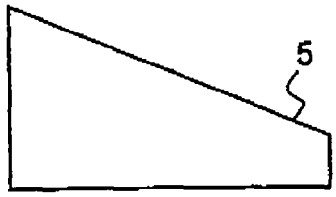

For example, as shown in FIG. 4, the outer element 3 may be made from a conductive sheet 5 in the shape of a right-angled triangle.

In a variant, the conductive sheet 5 may be in the form of a truncated right-angled triangle, so that the outer element 3 presents a minimum height along the roll axis that is not zero.

Figure 6:
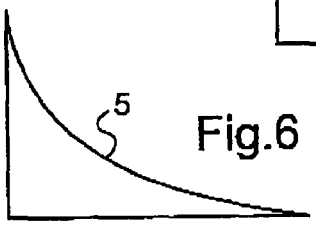

In a variant, as shown in FIG. 6, the conductive sheet 5 may have two sides that are perpendicular and a third side of a shape that is curvilinear, being of the decreasing exponential type.

Figure 7:
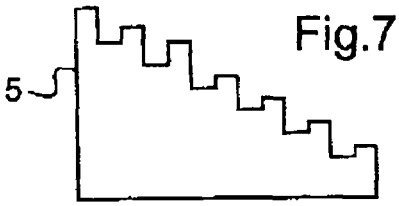

As shown in FIG. 7, the conductive sheet 5 may have a side that is formed by a succession of crenellations, with the height of the outer element varying along the roll, alternately increasing and decreasing.

Figure 8:
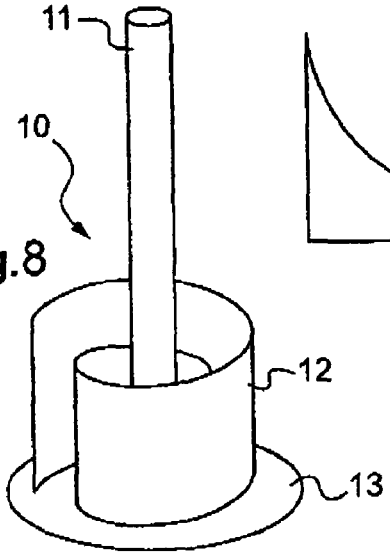
FIG. 8 is a diagrammatic and fragmentary view of a monopole antenna constituting an embodiment of the invention.

FIG. 8 shows an antenna 10 of the so-called "matching sleeve" type constituting another embodiment of the invention.

This antenna 10 is of the monopole type, and comprises a central radiating element 11, an outer element 12 rolled around the radiating element 11, and a ground element 13 to which the outer element 12 is connected. The outer element may be made integrally with the ground element.

The elements 11 and 12 may be made of conductive material, or in a variant they may be made using printed circuit cards.

In another variant, the radiating element 11 may be of the dipole type.

The outer element 12 may be considered as an extension of the ground element 13.

In the example described, the outer element 12 is constituted by rolling up a sheet that has the shape of a right-angled triangle.

Naturally, the outer element 12 may present one of the other shapes described above.

The antenna 10 makes it possible to obtain a bandwidth that is ultra-broad.

The influence of the ground element 13 on the operation of the antenna can be made to be very small by means of the invention.

The radiating element 11 may be a single piece or it may be assembled from a plurality of elements.

In the examples shown, the central radiating element and the outer element are concentric.

In a variant, the central radiating element could be off-center relative to the outer element.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. An antenna comprising:

at least one central longitudinal radiating element; and at least one outer element comprising at least one rolled-up electrically-conductive sheet disposed around the central element, without electrical contact therebetween, wherein a height of the at least one rolled-up electrically conductive sheet varies between a first end of the at least one rolled-up electrically conductive sheet and a second end of the at least one rolled-up electrically conductive sheet, such that the height varies by at least one of (a) decreasing and (b) increasing and decreasing in an alternating manner.

2. An antenna according to claim 1, wherein the conductive sheet possesses a first side defining a maximum height of the outer element, and a second side perpendicular to the first side, defining a base of the outer element.

3. An antenna according to claim 2, wherein the conductive sheet presents the shape of a right-angled triangle.

4. An antenna according to claim 2, wherein the conductive sheet has a third side interconnecting the first side and the second side and presenting the shape of a decreasing exponential.

5. An antenna according to claim 2, wherein the conductive sheet has a third side interconnecting the first and second sides and formed by a succession of crenellations.

6. An antenna according to claim 1, wherein the minimum height of the outer element is not zero.

7. An antenna according to claim 1, wherein the outer element comprises a rolled-up conductive sheet having the shape of an isosceles triangle with its base defining the maximum height of the outer element.

8. An antenna according to claim 1, wherein the outer element is rolled in a spiral.

9. An antenna according to claim 1, wherein the outer element is arranged to operate without contacting ground.

10. An antenna according to claim 9, wherein the central radiating element is a dipole.

11. An antenna according to claim 1, wherein the outer element is arranged to operate in contact with ground.

12. An antenna according to claim 11, wherein the central radiating element is a monopole.

13. An antenna according to claim 1, including a dielectric material surrounding the central radiating element and the outer element.

14. An antenna according to claim 1, wherein the outer element is rolled in a variable-pitch spiral.

* * * * *